US009935387B2

(12) United States Patent
Chen

(10) Patent No.: US 9,935,387 B2
(45) Date of Patent: Apr. 3, 2018

(54) C-TYPE FEMALE CONNECTOR

(71) Applicant: Bingshui Chen, Xiamen (CN)

(72) Inventor: Bingshui Chen, Xiamen (CN)

( * ) Notice: Subject to any disclaimer, the term of this patent is extended or adjusted under 35 U.S.C. 154(b) by 156 days.

(21) Appl. No.: 15/043,628

(22) Filed: Feb. 15, 2016

(65) Prior Publication Data

US 2017/0012379 A1 Jan. 12, 2017

(30) Foreign Application Priority Data

Jul. 8, 2015 (CN) ..... 2015 2 0486826 U

(51) Int. Cl.

| | |
|---|---|
| ***H01R 13/11*** | (2006.01) |
| ***F21V 23/00*** | (2015.01) |
| ***F21K 9/232*** | (2016.01) |
| ***F21K 9/27*** | (2016.01) |

(52) U.S. Cl.

CPC ..... *H01R 13/11* (2013.01); *F21K 9/232* (2016.08); *F21K 9/27* (2016.08); *F21V 23/006* (2013.01)

(58) Field of Classification Search

CPC ..... H01R 13/41; H01R 33/08
USPC ..... 439/733.1, 619, 699.2, 857
See application file for complete search history.

(56) References Cited

U.S. PATENT DOCUMENTS 3,332,054 A * 7/1967 Jacinto Fernandes . H01R 4/184 439/868
4,317,609 A * 3/1982 Lapraik ..... H01R 23/70 439/636
6,478,637 B1 * 11/2002 Ohkita ..... H01R 13/193 439/342
6,971,917 B2 * 12/2005 Faust ..... H01R 13/508 439/619
6,979,235 B2 * 12/2005 Lappohn ..... H01R 13/111 439/733.1
7,601,036 B2 * 10/2009 Cheng ..... H01R 13/11 439/857
7,744,431 B2 * 6/2010 Trout ..... H01R 13/112 439/733.1
7,896,678 B2 * 3/2011 Zhang ..... H01R 12/57 439/342
2009/0269950 A1 * 10/2009 Liao ..... H01R 13/2435 439/66
2013/0040505 A1 * 2/2013 Hirakawa ..... H01R 12/721 439/733.1
2013/0107550 A1 * 5/2013 Urano ..... H01R 12/721 362/382
2015/0345766 A1 * 12/2015 Wang ..... F21V 23/00 362/382

* cited by examiner

*Primary Examiner* — Tulsidas C Patel
*Assistant Examiner* — Marcus Harcum
(74) *Attorney, Agent, or Firm* — Leong C. Lei

(57) ABSTRACT

The C-type female connector contains at least a C-shaped clamp. The C-shaped clamp contains a base, one or two flexible arm pieces extended from the base's lateral sides toward each other, respectively, thereby forming a C shape. Along a slit between front edges of the arm pieces, each arm piece has a flexible contact section. The C-shaped clamp further contains a plug piece for positioning extended from a bottom edge, and a contact piece for establishing electrical connection extended from a top edge, of the base. The connector is structurally simple, efficient to assemble, more reliable, and has highly improved yield.

9 Claims, 14 Drawing Sheets

C-TYPE FEMALE CONNECTOR

BACKGROUND OF THE INVENTION (a) Technical Field of the Invention

The present invention is generally related to connectors, and more particular to a C-type female connector and a light emitting diode (LED) lamp using the C-type female connector.

(b) Description of the Prior Art

In an existing light emitting diode (LED) lamp, between the light source board and the driver board, and between the driver board and the lamp, the electrical connection is often achieved through wires and soldering. This kind of wired connection has a complicated process, low assembly efficiency, and inferior yield.

SUMMARY OF THE INVENTION

The present invention also provides a light emitting diode (LED) lamp, which contains a transparent member, a light source board, a driver board, a base member, a cap member; and a C-type female connector described above. The transparent member is joined to the base member which in turn is joined to the cap member. The light source board is housed in the transparent member, and the driver board is configured in the base member. The C-type female connector is configured on the light source board with the soldering sections soldered to the light source board to establish electrical connection. The driver board has male connector for plugging into the C-shaped clamp and contacting the arm pieces so that the light source board is electrically connected to the driver board.

The present invention provides another LED lamp, which contains a transparent member, a light source board, a driver board, a base member, a cap member; and a C-type female connector described above. The transparent member is joined to the base member which in turn is joined to the cap member. The light source board is housed in the transparent member. The C-type female connector is configured in the cap member with a through hole riveted by a bolt to the cap member so as to establish electrical connection therebetween. The driver board has a male connector for plugging into the C-shaped clamp and contacting the arm pieces so that the driver board is electrically connected to the cap member.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
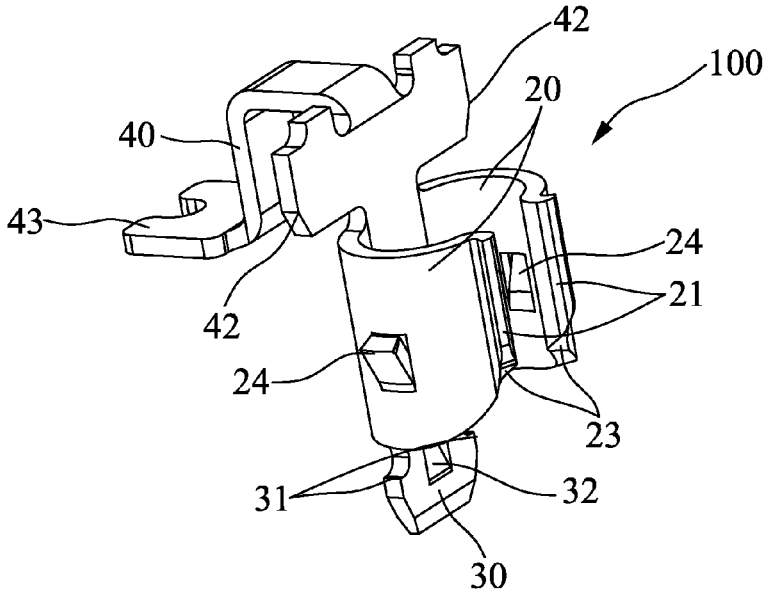
FIG. 1 is a perspective diagram showing a C-shaped clamp according to a first embodiment of the present invention.
Figure 2:
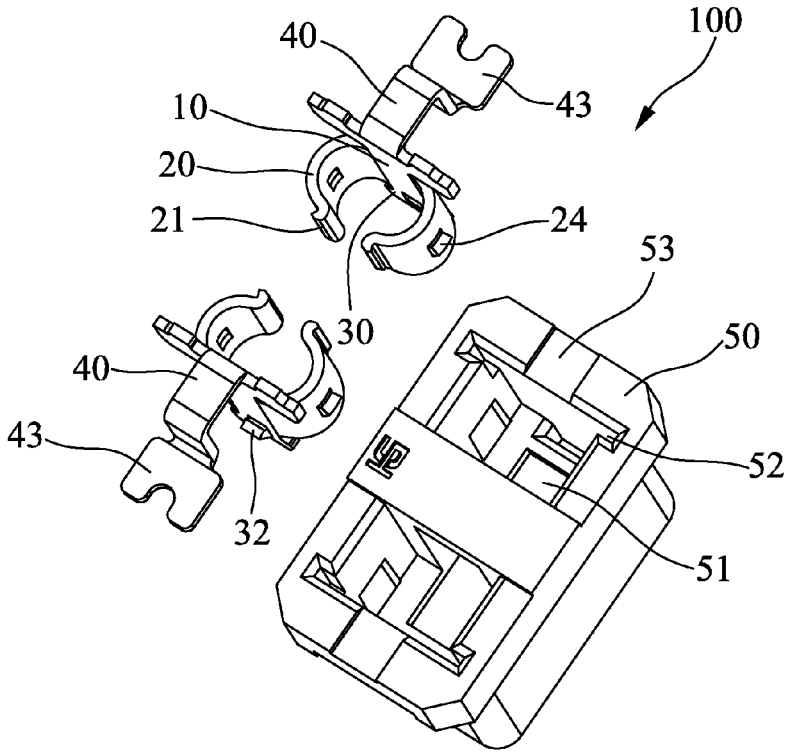
FIG. 2 is a perspective diagram showing a plastic seat and two C-shaped clamps of FIG. 1 of a C-type female connector.
Figure 3:
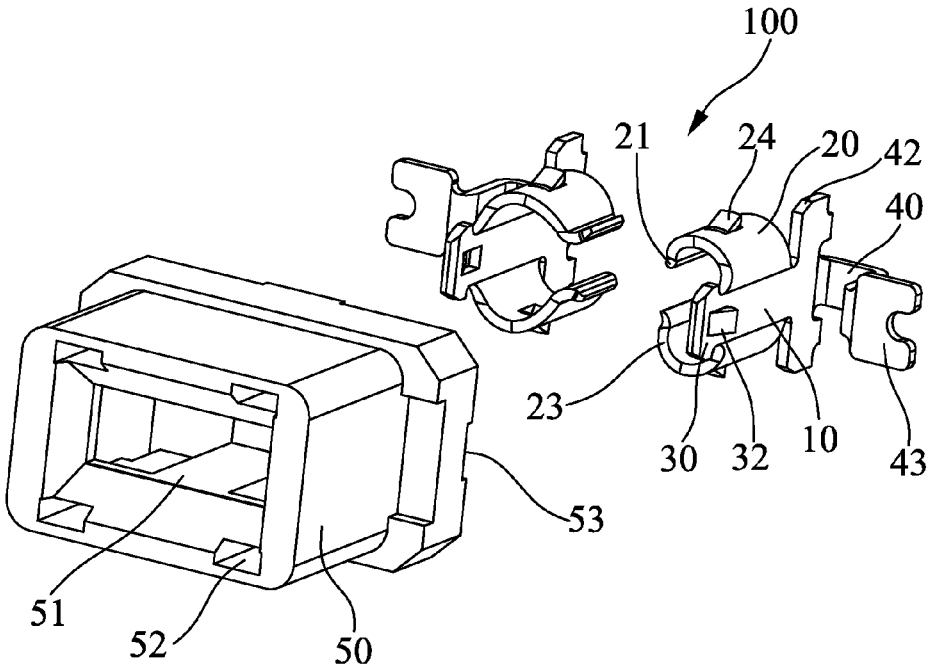
FIG. 3 is another perspective diagram showing the C-type female connector of FIG. 2.
Figure 4:
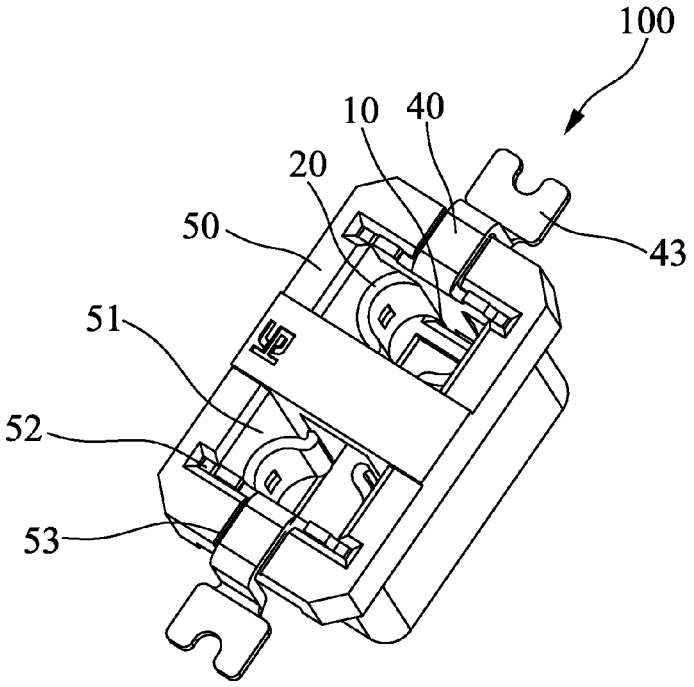
FIG. 4 is a perspective diagram showing the C-type female connector of FIG. 2 after its assembly.
Figure 5:
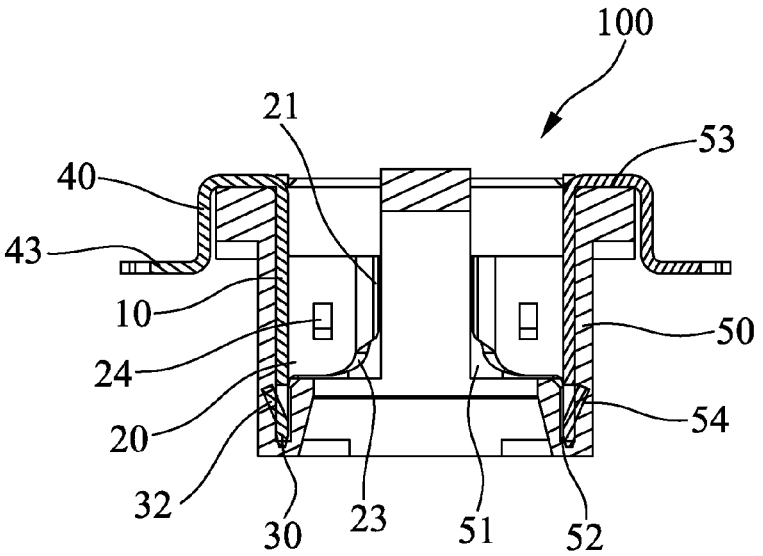
FIG. 5 is a sectional diagram showing the C-type female connector of FIG. 4.
Figure 6:
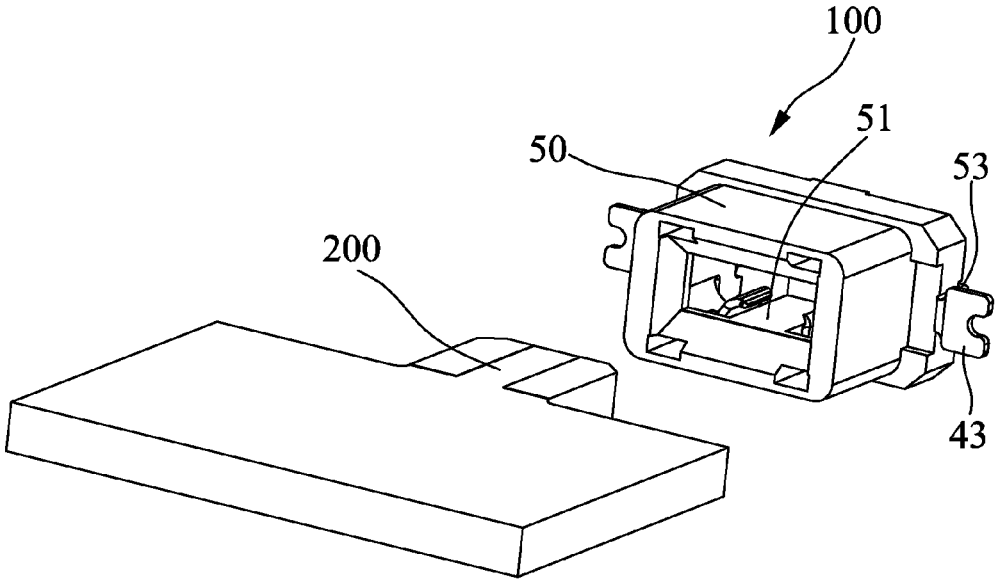
FIG. 6 is a perspective diagram showing the C-type female connector of FIG. 4 and a corresponding male connector.
Figure 7:
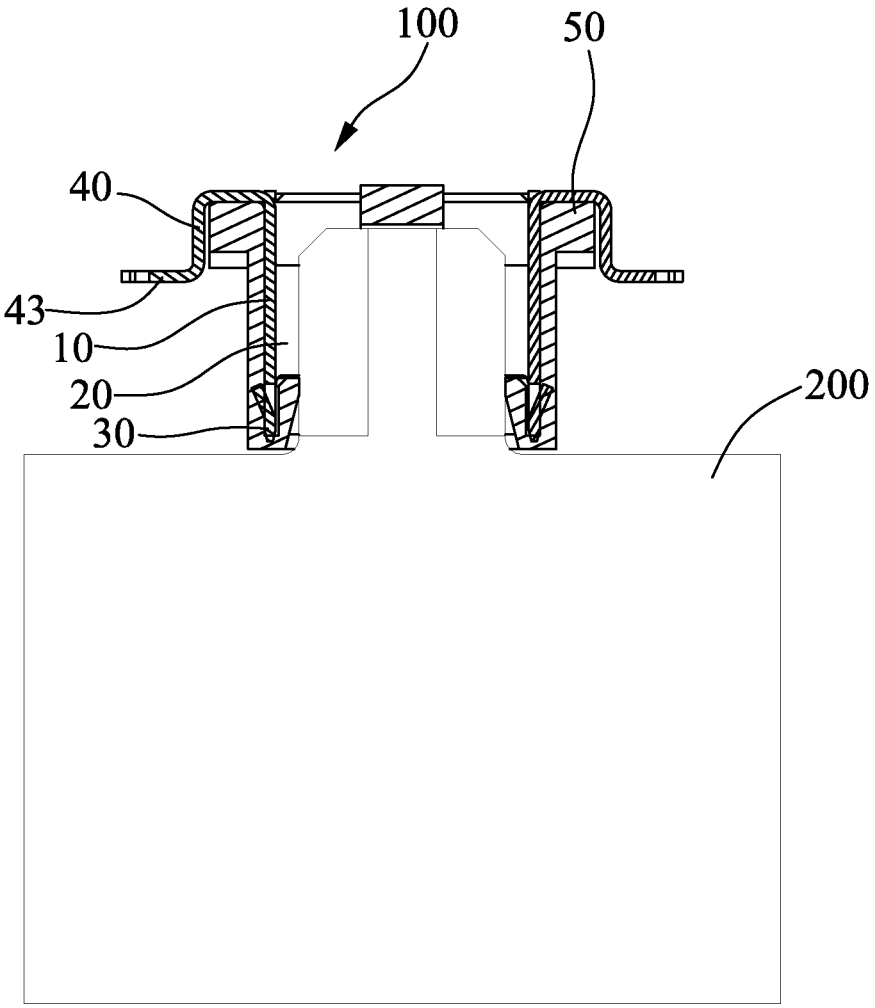
FIG. 7 is a sectional diagram showing the C-type female connector and the male connector of FIG. 6 after their connection.
Figure 8:
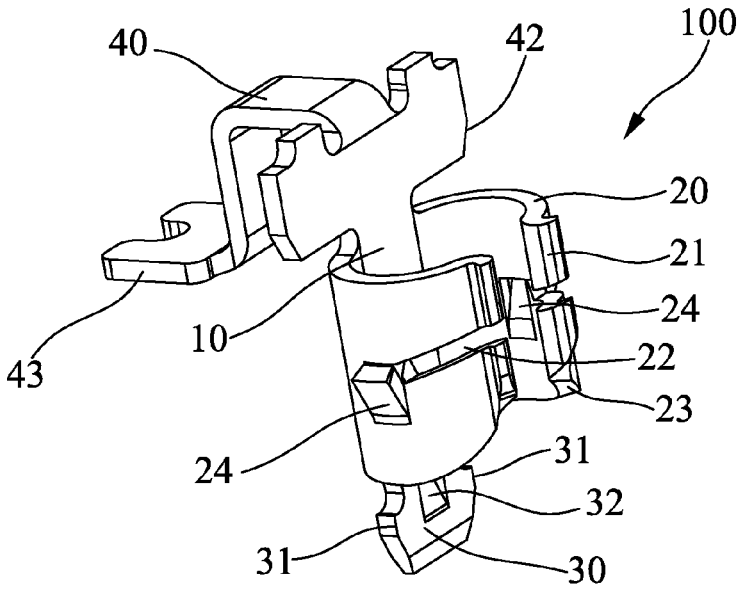
FIGS. 8 to 10 are perspective diagrams showing C-shaped clamps according to a second, a third, and a fourth embodiments of the present invention.
Figure 9:
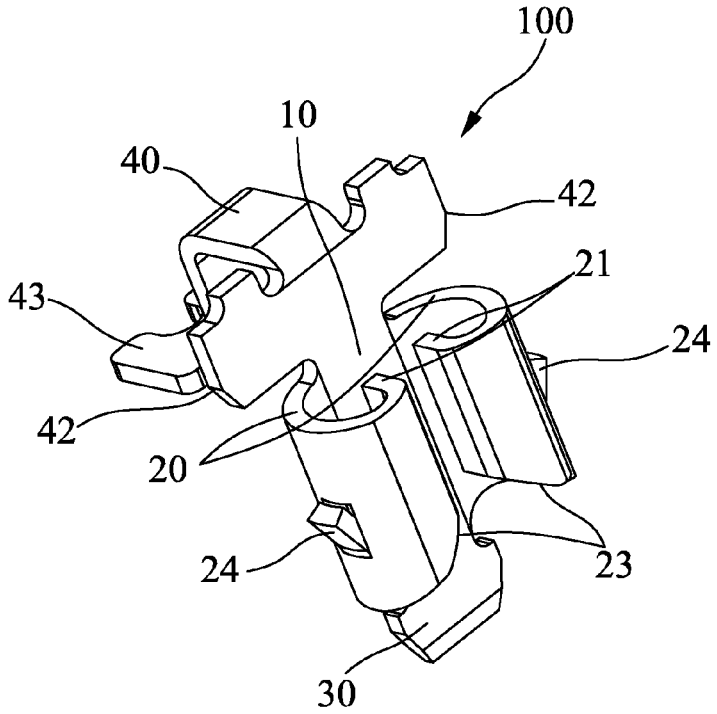
Figure 10:
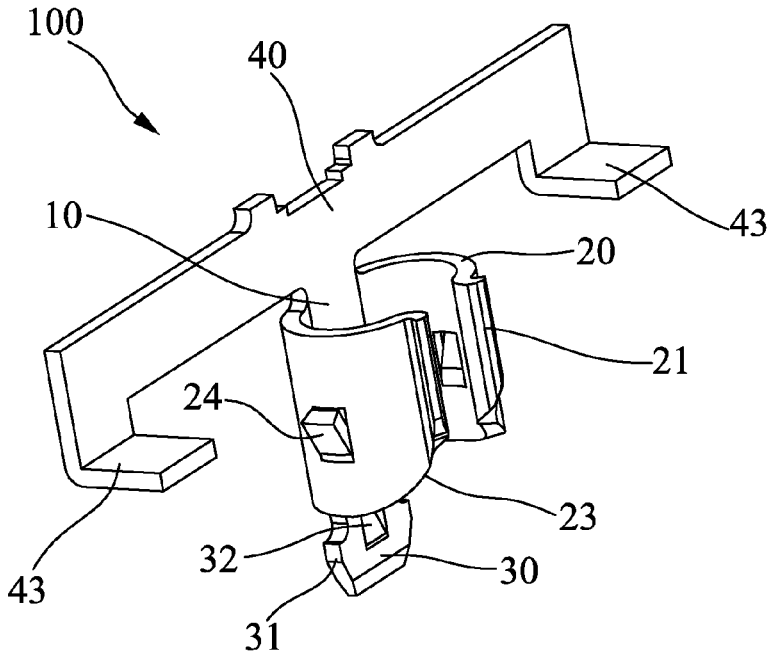
Figure 11:
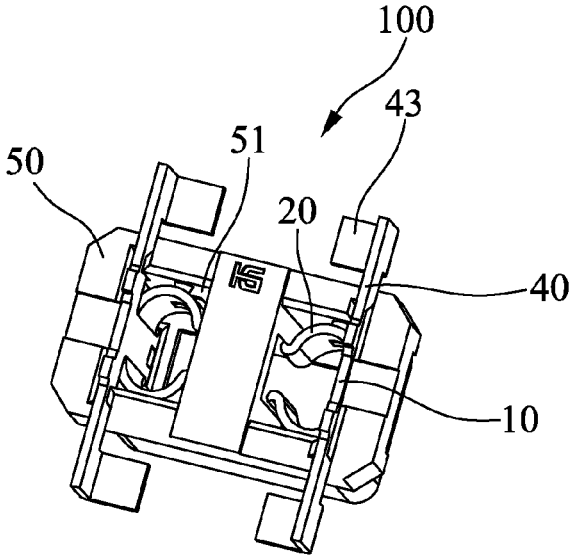
FIG. 11 is a perspective diagram showing a C-type female connector with the C-shaped clamps of FIG. 10.
Figure 12:
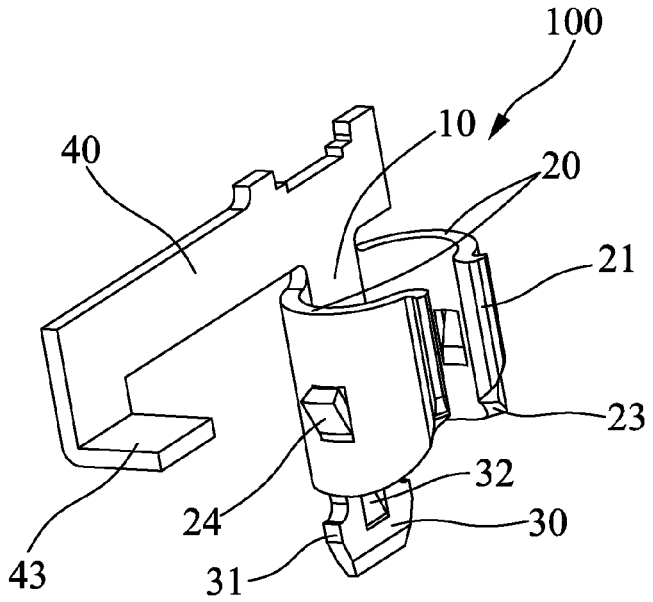
FIG. 12 is a perspective diagram showing a C-shaped clamp according to a fifth embodiment of the present invention.
Figure 13:
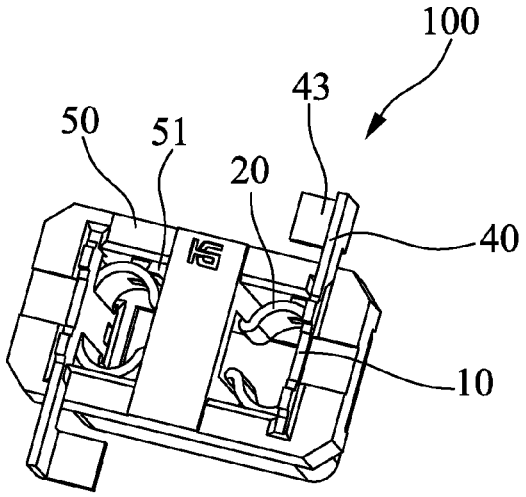
FIG. 13 is a perspective diagram showing a C-type female connector with the C-shaped clamps of FIG. 12.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 25, the present disclosure provides a C-type female connector 100 which contains at least a C-shaped clamp. The C-shaped clamp contains a base 10, one or two flexible arm pieces 20 extended from the base 10's lateral sides toward each other, respectively, thereby forming a C shape. Along a slit between front edges of the arm pieces 20, each arm piece 20 has a flexible contact section 21. The C-shaped clamp further contains a plug piece 30 for installation and positioning extended from a bottom edge, and a contact piece 40 for establishing electrical connection extended from a top edge, of the base 10.

The C-shaped clamp of the C-type female connector 100 can have one or two arm pieces 20. In a ninth embodiment shown in FIG. 24, there is only one arm piece 20 and a smaller C shape is formed. The arm pieces 20 can be curved or, as shown in an eighth embodiment of FIG. 23, one of the arm pieces 20 is a flat piece. In a first embodiment of FIG. 1, a second embodiment of FIG. 8, a fourth embodiment of FIG. 10, a fifth embodiment of FIG. 12, a sixth embodiment of FIG. 19, and a seventh embodiment of FIG. 22, each arm piece 20 has a flexible contact section 21 along a front edge bordering the slit of the C shape. The contact sections 21 are bended away from the slit. In the seventh embodiment shown in FIG. 22, the contact sections 21 are extended for a greater distance. In a third embodiment shown in FIG. 9, the contact sections 21 are bended toward the inside of the C-shaped clamp. In the eighth embodiment shown in FIG. 23, and in the ninth embodiment shown in FIG. 24, the front edge of each arm piece 20 directly functions as the contact section 21. In the second embodiment of FIG. 2 and the sixth embodiment of FIG. 19, each arm piece 20 has a slot 22 opened perpendicularly from the front edge, thereby doubling the number of contact sections 21.

To facilitate the insertion of a male connector 200 (e.g., shown in FIGS. 6 and 7), the front edge of each arm piece 20 has a slant bottom.

Figure 19:
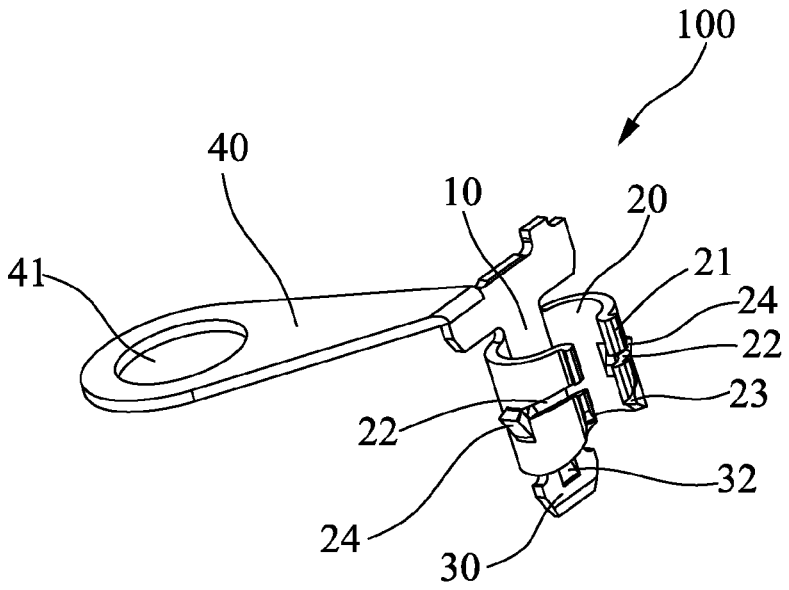
FIG. 19 is a perspective diagram showing a C-shaped clamp according to a sixth embodiment of the present invention.
Figure 20:
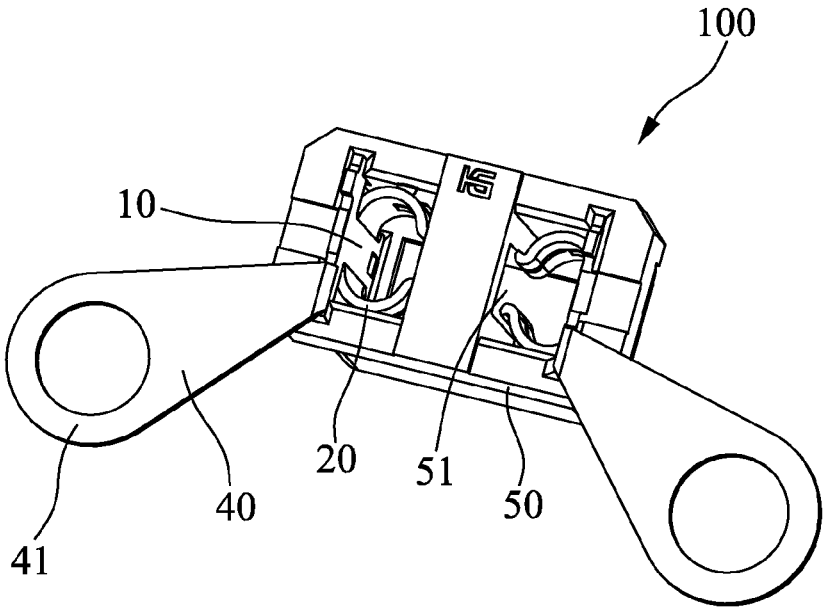
FIG. 20 is a perspective diagram showing a C-type female connector with the C-shaped clamps of FIG. 19.

Except the sixth embodiment shown in FIG. 19, the contact piece 40 of the first to the fifth embodiments and the seventh to the ninth embodiments has at least a soldering section 43 extended perpendicularly from the contact piece 40. These embodiments, except the fourth embodiment shown in FIG. 10 and the fifth embodiment shown in FIG. 12, has the soldering sections 43 extended toward a first side of the contact piece 40 away from the arm pieces 20. The fourth embodiment shown in FIG. 10 has the soldering sections 43 extended from two ends of the contact piece 40 toward a second side where the arm pieces 20 are located. The fifth embodiment of FIG. 12 has the soldering section 43 extended from an end of the contact piece 40 toward the second side. The sixth embodiment shown in FIG. 19 does not have soldering section 43 but have a through hole 41 for riveting by an electrically conducting terminal.

To facilitate assembly, the C-type female connector 100 further contains a plastic seat 50 having two accommodation chambers 51. A C-shaped clamp of the C-type female connector 100 is housed in an accommodation chamber 51. Each accommodation chamber 51 has a socket 52 along a circumferential wall for receiving the plug piece 30, and an indentation 53 along a top border for the embedment of a horizontal section of the contact piece 40. The soldering sections 43 are exposed outside the plastic seat 50. As shown in FIGS. 2 to 5, the two accommodation chambers 51 are oppositely positioned and connected. The two C-shaped clamps have their slits facing each other and, when the male connector 200 is plugged into a bottom side of the plastic seat 50, each lateral side of the male connector 200 is clamped by a C-shaped clamp where electrical connection is achieved.

To secure the C-shaped clamp, each arm piece 20 has an outward protruding anti-escape wedge 24 on a circumferential face, and the plug piece 30 has an anti-escape wedge 32 on an outer side and at least a notch 31 on a lateral edge. For the first to the third embodiment, and the seventh to the ninth embodiment, a vertical section of the contact piece 40 connecting the base 10 has at least a lateral bottom cut corner 42. Correspondingly, each accommodation chamber 51 has notches 54 on circumferential walls for the embedment of the anti-escape wedges 24 and 32. The cut corners 31 and notches 31 are for the C-shaped clamp's tightly joint to the accommodation chamber 51's circumferential walls.

Figure 14:
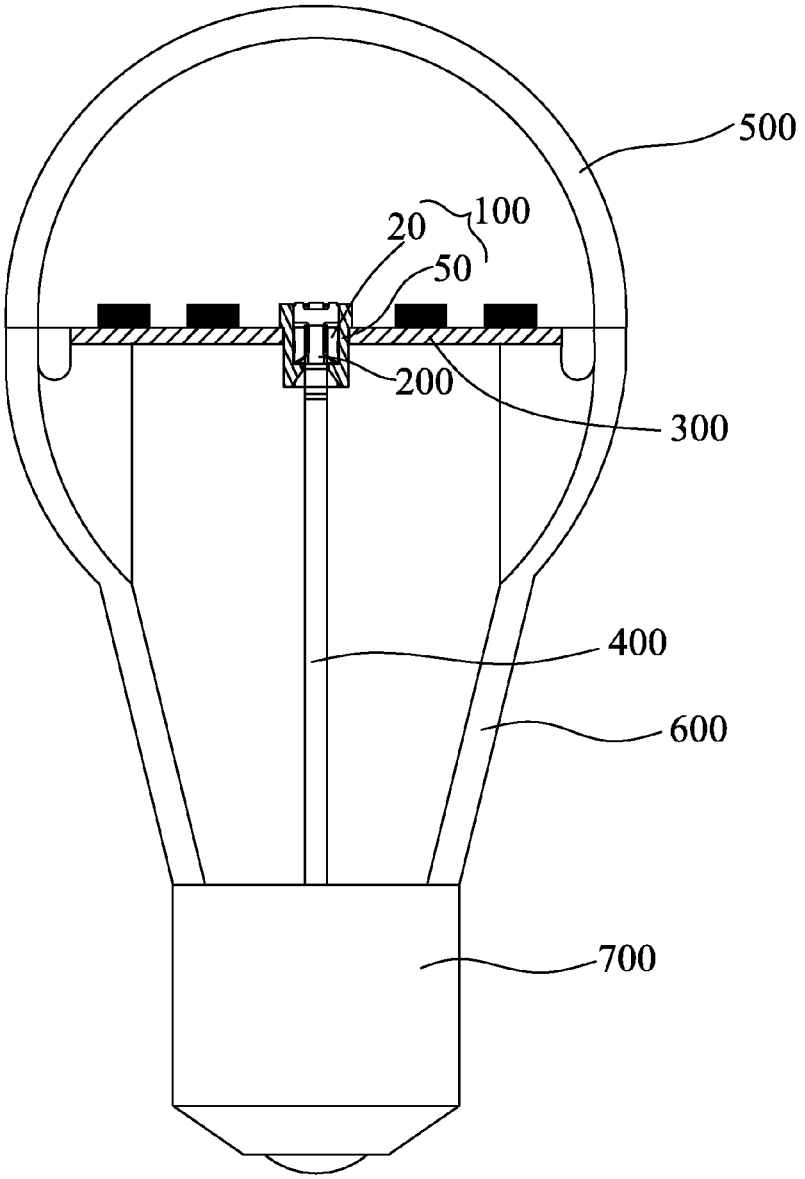
FIG. 14 is a sectional diagram showing a light emitting diode (LED) lamp with a C-type female connector according to one of the first to the fifth embodiments of the present invention.
Figure 15:
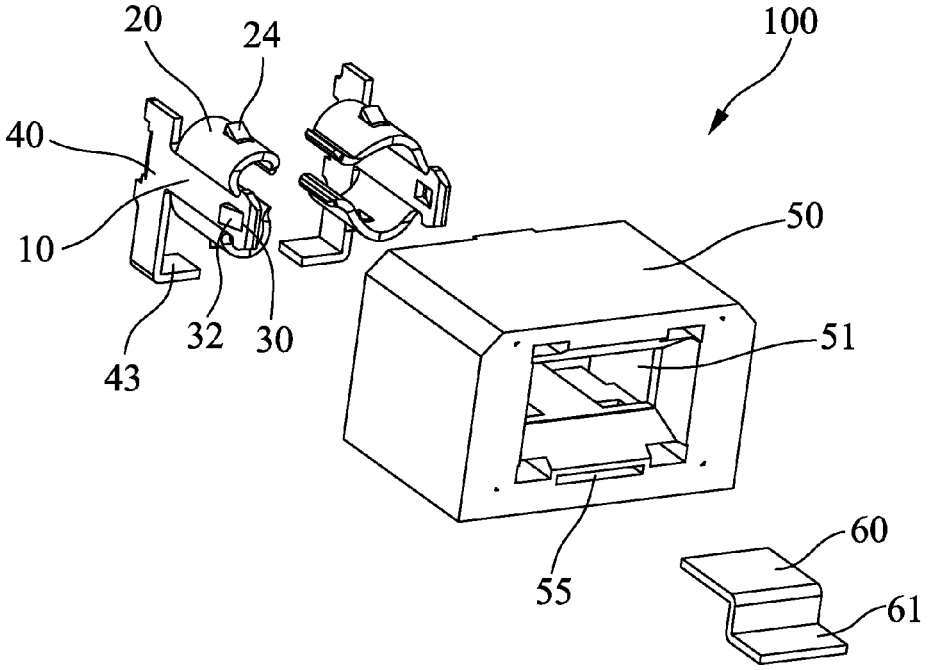
FIG. 15 is a perspective diagram showing a C-type female connector with C-shaped clamps of the fifth embodiment.
Figure 16:
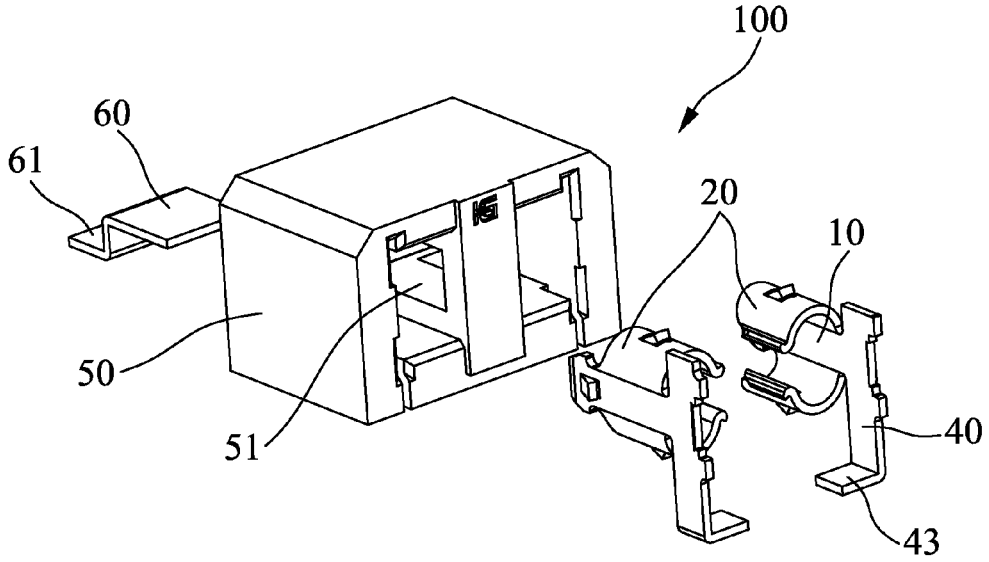
FIG. 16 is another perspective diagram showing the C-type female connector of FIG. 15.
Figure 17:
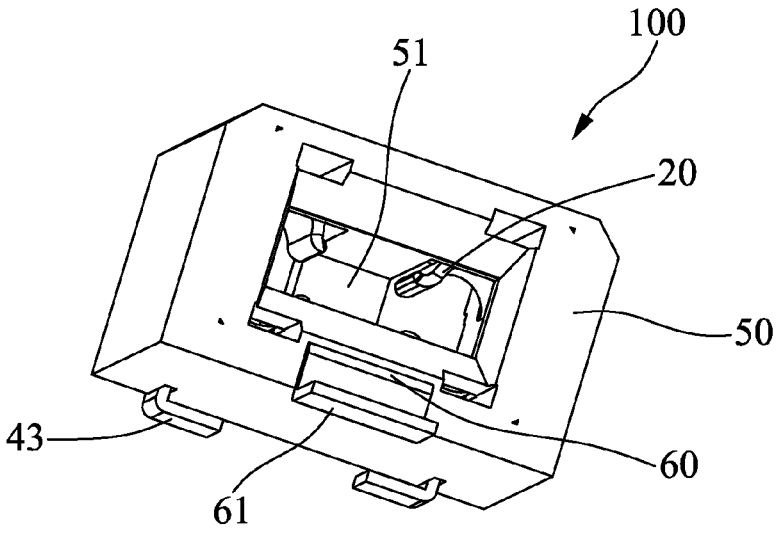
FIG. 17 is a perspective diagram showing the C-type female connector of FIG. 15 after its assembly.

The C-type female connector 100 according to one of the first to the fifth embodiment, and the seventh to the ninth embodiment can be employed in a LED light bulb as shown in FIG. 14 for vertically connecting a light source board 300 and a driver board 400. The LED light bulb contains a bulb-shaped transparent member 500, the light source board 300, the driver board 400, a base member 600, and a cap member 700. The transparent member 500 is joined to the base member 600 which in turn is joined to the cap member 700. The light source board 300 is housed in the transparent member 500, and the driver board 400 is configured in the base member 600. The C-type female connector 100 is configured on the light source board 300 where the soldering sections 43 are soldered to the light source board 300 to establish electrical connection. The driver board 400 contains the male connector 200 for plugging into the C-type female connector 100 and contacting the contact sections 21 of the arm pieces 20 so that the light source board 300 is electrically connected to the driver board 400. The male connector 200 can contain PCB gold fingers or positive pin terminals (with or without plastic cores). The pin terminals directly contact the contact sections 21 to establish electrical connection between the light source board 300 and the driver board 400.

Figure 18:
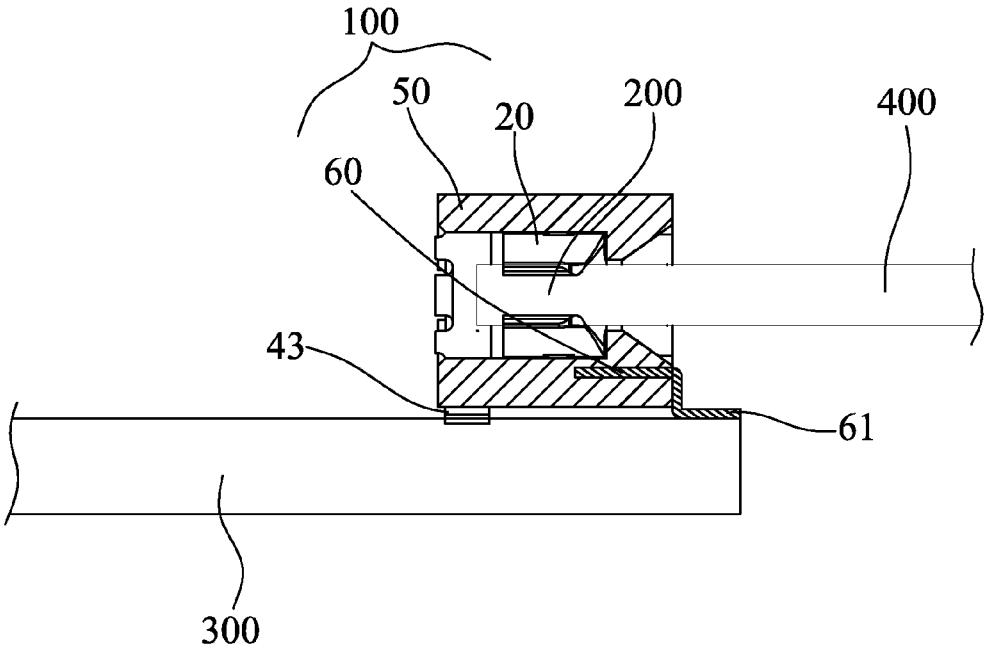
FIG. 18 is a sectional diagram showing the C-type female connector of FIG. 17 applied in a LED light tube.

The C-type female connector 100 according to the fourth embodiment can be employed in a LED light tube as shown in FIG. 18 for laterally connecting a light source board 300 and a driver board 400. As illustrated, the C-type female connector 100 is configured on the light source board 300 where the soldering sections 43 are soldered to the light source board 300 to establish electrical connection. The plastic seat 50 further contains an auxiliary soldering piece 60 having an end plugged into an auxiliary slot 55 on a top border of an accommodation chamber 51 and another end extended outside the plastic seat 50 to form a soldering section 61. The soldering section 61 is also soldered to the light source board 300. With the soldering sections 43 and 61, the C-type female connector 100 is reliably fixed to the light source board 300. The driver board 400 contains the male connector 200 for plugging into the C-type female connector 100 and contacting the contact sections 21 of the arm pieces 20 so that the light source board 300 is electrically connected to the driver board 400.

Figure 21:
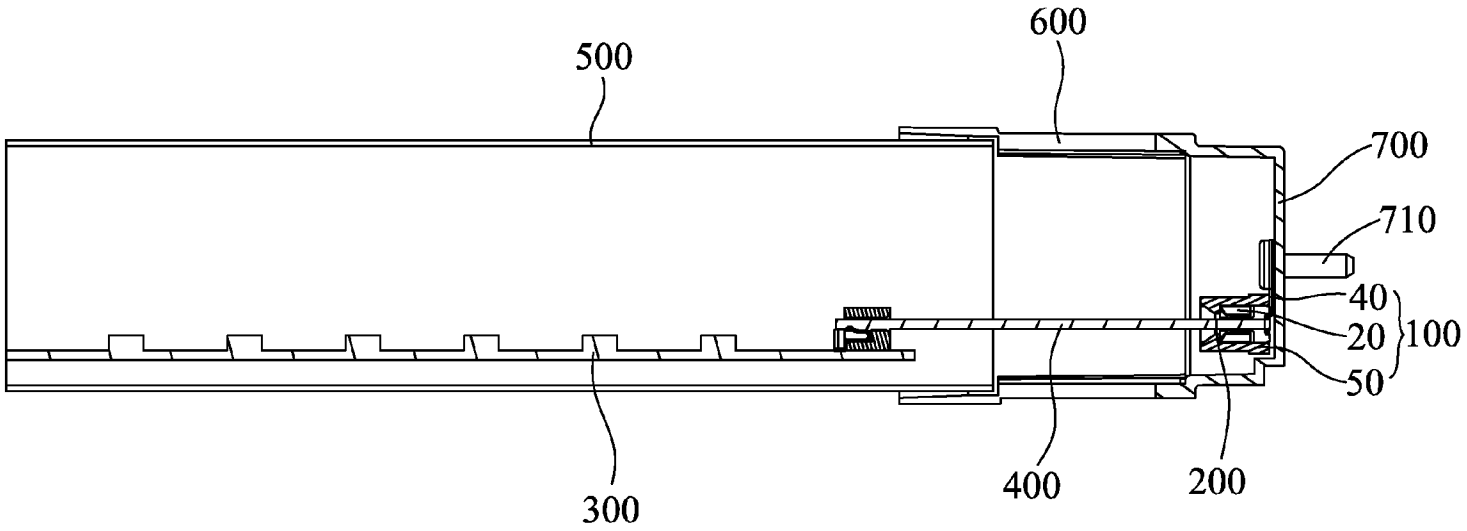
FIG. 21 is a sectional diagram showing the C-type female connector of FIG. 20 applied in a LED lamp.
Figure 22:
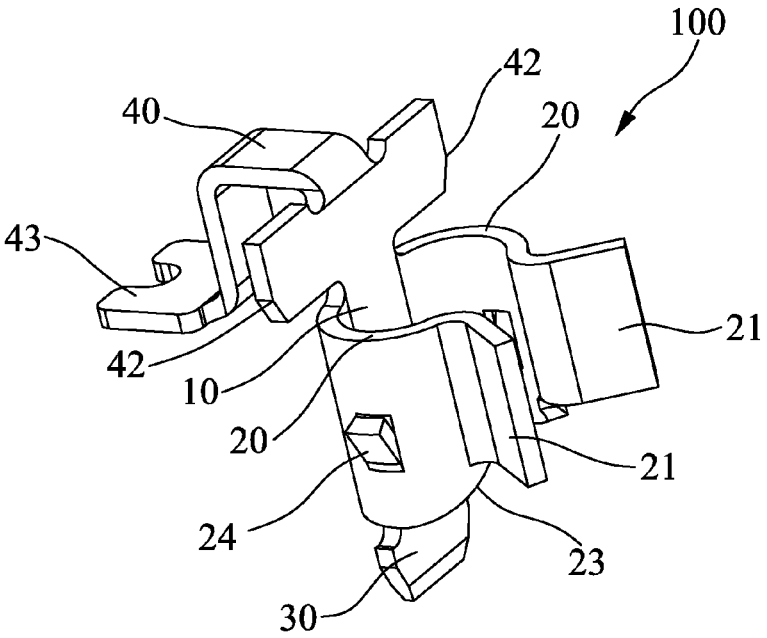
FIGS. 22 to 24 are perspective diagrams showing C-shaped clamps according to a seventh, an eighth, and a ninth embodiments of the present invention.
Figure 23:
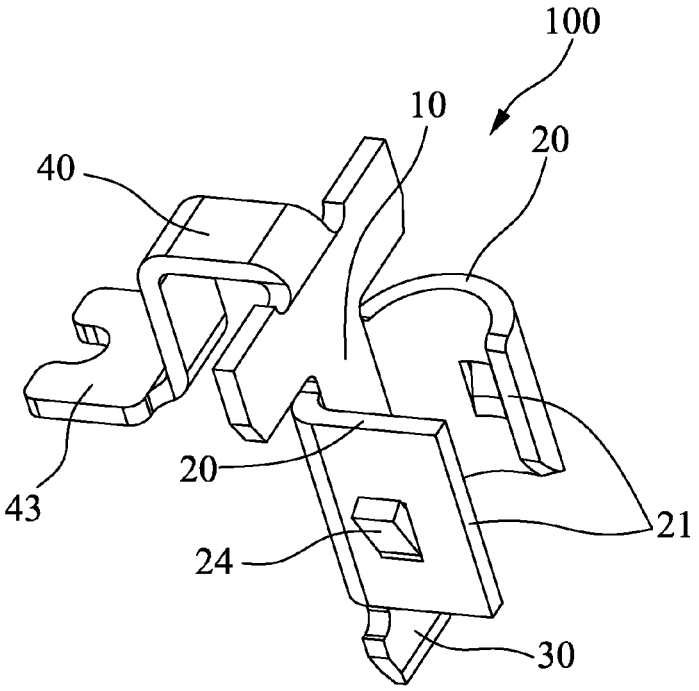
Figure 24:
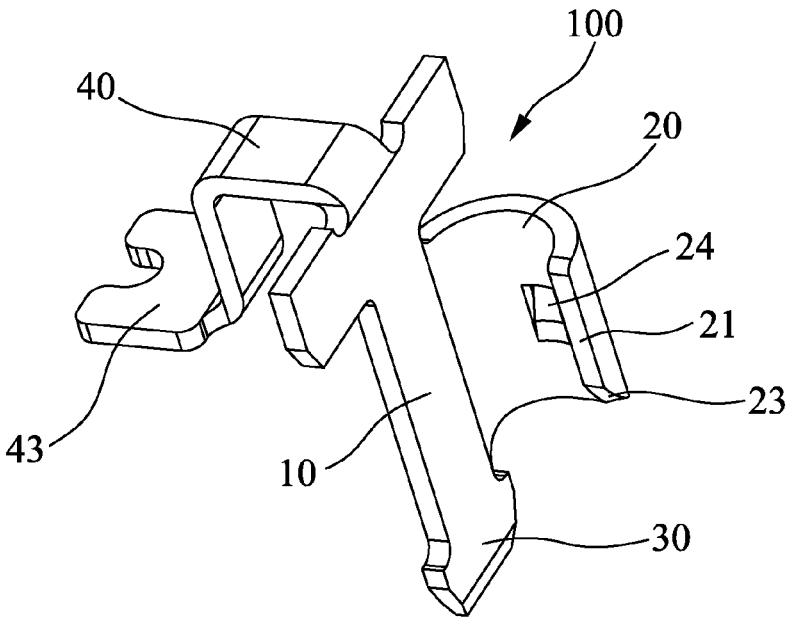
Figure 25:
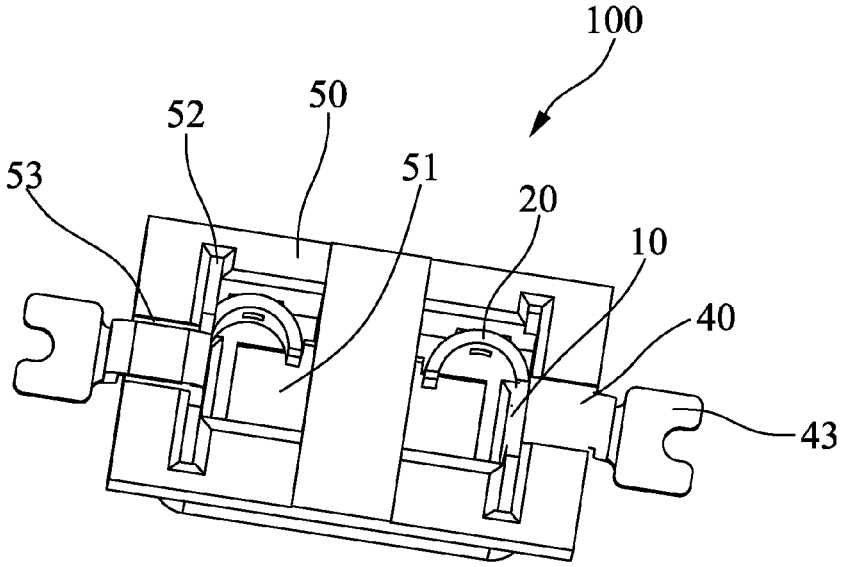
FIG. 25 is a perspective diagram showing a C-type female connector with the C-shaped clamps of FIG. 24.

The C-type female connector 100 according to the sixth embodiment can also be employed in a LED lamp as shown in FIG. 21 for electrically connecting a driver board 400 to a cap member 700. The LED lamp contains a transparent member 500, a light source board 300, the driver board 400, a base member 600, and a cap member 700. The transparent member 500 is joined to the base member 600 which in turn is joined to the cap member 700. The light source board 300 is housed in the transparent member 500, and the driver board 400 is configured in the cap member 700. The C-type female connector 100 is configured in the cap member 700 where the through hole 41 of the contact piece 40 is riveted by a bolt 710 to the cap member so as to establish electrical connection therebetween. The driver board 400 contains the male connector 200 for plugging into the C-type female connector 100 and contacting the contact sections 21 of the arm pieces 20 so that the driver board 400 is electrically connected to the cap member 700.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A C-type female connector, comprising a C-shaped clamp; wherein the C-shaped clamp comprises:

a base, a plurality of flexible arm pieces extended from the base's lateral sides, a plug piece for installation and positioning extended from a bottom edge of the base;

a contact piece for establishing electrical connection extended from a top edge of the base;

each of the flexible arm pieces having a flexible contact section along a front edge of the flexible arm pieces; and a plastic seat comprising two accommodation chambers, each housing a C-shaped clamp of the C-type female connector, each of the two accommodation chambers having a socket along a circumferential wall for receiving the plug piece, and an indentation along a top border for the embedment of a horizontal section of the contact piece, the two accommodation chambers being oppositely positioned and connected, and the two C-shaped clamps facing each other.

2. The C-type female connector according to claim 1, wherein the C-shaped clamp comprises two flexible arm pieces extended from the base's lateral sides toward each other, respectively, thereby forming a C shape; and each arm piece has a flexible contact section along a front edge bordering a slit between the arm pieces.

3. The C-type female connector according to claim 1, wherein each arm piece has a slot opened perpendicularly from the front edge.

4. The C-type female connector according to claim 1, wherein the contact piece comprises at least a soldering section extended toward a first side of the contact piece away from the arm pieces.

5. The C-type female connector according to claim 1, wherein the contact piece comprises at least a soldering section extended toward a second side where the arm pieces are located.

6. The C-type female connector according to claim 1, wherein the contact piece comprises a through hole for riveting by an electrically conducting terminal.

7. The C-type female connector according to claim 1, wherein each arm piece has an outward protruding first anti-escape wedge on a circumferential face; the plug piece has a second anti-escape wedge on an outer side and at least a notch on a lateral edge; a vertical section of the contact piece connecting the base has at least a lateral bottom cut corner; each accommodation chamber has correspondingly notches on circumferential walls for the embedment of the first and second anti-escape wedges; and the cut corners notches are for the C-shaped clamp's tightly joint to the accommodation chamber's circumferential walls.

8. The C-type female connector according to claim 1, wherein the plastic seat further comprises an auxiliary soldering piece having an end plugged into an auxiliary slot on a top border of an accommodation chamber and another end extended outside the plastic seat to form a soldering section.

9. A light emitting diode (LED) lamp, comprising a transparent member, a light source board, a driver board, a base member, a cap member; and a C-type female connector according to claim 6; wherein the transparent member is joined to the base member which in turn is joined to the cap member; the light source board is housed in the transparent member; the C-type female connector is configured in the cap member with the through hole riveted by a bolt to the cap member so as to establish electrical connection therebetween; the driver board has a male connector for plugging into the C-shaped clamp and contacting the arm pieces so that the driver board is electrically connected to the cap member.

* * * * *